US005302965A

United States Patent [19]

Belcher et al.

[11] Patent Number: 5,302,965

[45] Date of Patent: Apr. 12, 1994

[54] DISPLAY

[75] Inventors: Barry J. Belcher, Berks; Clive V. Mott, Middlesex, both of Great Britain

[73] Assignee: Stellar Communications Limited, England

[21] Appl. No.: 768,953

[22] PCT Filed: Apr. 12, 1990

[86] PCT No.: PCT/GB90/00564

§ 371 Date: Oct. 15, 1991

§ 102(e) Date: Oct. 15, 1991

[87] PCT Pub. No.: WO90/12354

PCT Pub. Date: Oct. 18, 1990

[30] Foreign Application Priority Data

Apr. 13, 1989 [GB] United Kingdom ..... 8908322

[51] Int. Cl.[5] ..... G09G 3/20

[52] U.S. Cl. ..... 345/31; 345/46; 340/815.45

[58] Field of Search ..... 300/755, 750, 756, 762, 300/815.03

[56] References Cited

U.S. PATENT DOCUMENTS 4,200,869 4/1980 Murayama et al. ..... 340/750
4,491,863 1/1985 Krozahashi ..... 340/703
4,593,978 1/1986 Mowrey et al. ..... 340/703
4,689,604 8/1987 Sokol ..... 340/755

FOREIGN PATENT DOCUMENTS 0156544 10/1985 European Pat. Off. .
2551662 2/1977 Fed. Rep. of Germany .
3132394 10/1983 Fed. Rep. of Germany .
55013689 3/1980 Japan .
5125424 12/1980 Japan .
8002218 10/1980 PCT Int'l Appl. .
2093617 9/1982 United Kingdom .

*Primary Examiner*—Alvin E. Oberley
*Assistant Examiner*—Regina Liang
*Attorney, Agent, or Firm*—Andrus, Sceales, Starke & Sawall

[57] ABSTRACT

A display comprises a static unit (8) on which is mounted a rotating unit (7) driven by a motor (12). The rotating unit carries light emitting diodes (6) arranged as vertical columns which sweep around a cylindrical surface. The light emitting diodes (6) are controlled by a control circuit (6) in accordance with data stored in a memory (61) so as to provide a cylindrical display. The control circuit (60) and memory (61) are located in the rotating unit 97) and the memory (612) has a capacity for storing several different images for display.

8 Claims, 8 Drawing Sheets

DISPLAY

BACKGROUND OF THE INVENTION

1. Field of the Invention

The present invention relates to a display.

2. Description of the Related Art

A known type of display comprises a static base unit and a rotating unit driven by a motor The rotating unit carries a plurality of light emitting diodes (LED's) which are controlled during rotation so as to provide a display image.

EP 0 26 762 discloses a display of this type in which a rotating two dimensional array of LED's sweeps a cylindrical volume and the LED's are controlled so as to define a cylindrical three dimensional array of picture elements (pixels). Data for controlling illumination of the pixels is sent in serial form from fixed electronics in the base unit via an infrared link to rotating electronics in the rotating unit. The rotating electronics essentially comprise a decoder for illuminating each LED of the array in sequence, with no data storage being provided in the rotating unit. Thus, only one LED at a time can be illuminated.

GB 2 093 617 and EP 0 156 544 disclose displays of this type in which two diametrically opposite vertical columns of LED's sweep a common cylindrical display surface and the LED's are controlled so as to define a cylindrical two dimensional array of pixels. The rotating unit contains enough electronics and memory for all of the LED's to be controlled simultaneously and for data to be stored for all of the pixels to provide one complete image. In order to change the displayed image, a connection has to be established with the rotating unit so that new data can be written into the memory. During such reprogramming, the display ceases to function as a display until the old data have been replaced by the new data. Thus, display images cannot be changed during normal operation of the display. This makes image updating and animation difficult or impossible and requires expert or trained personnel to reprogrammed the display.

Another problem with known displays of this type is that the light output is relatively low. Thus, shaded locations are necessary for viewing such displays.

SUMMARY OF THE INVENTION

According to a first aspect of the invention, there is provided a display comprising a static unit and a moving unit, the moving unit carrying a plurality of light sources and being arranged to move so that the light sources perform a repeated movement, the moving unit including a memory for storing data for providing a plurality of displayed images and control means for controlling the light sources so as to display at least one selected image at a time.

The moving unit is preferably a rotating unit and the light sources are preferably arranged as a plurality of columns parallel to the axis of rotation. The light sources are preferably light emitting diodes.

The static unit is preferably arranged to communicate with the moving unit by means of a communication link, such as a rotary transformer. Preferably the static unit contains a further memory for storing data for a plurality of further displayed images and transmission means for transmitting the data to the memory and the control means of the moving unit via the communication link.

It is thus possible to provide a display which permits several images to be displayed in a desired sequence, for instance so as to change the images or so as to provide animated images According to a second aspect of the invention, there is provided a display comprising a static unit and a rotating unit, the rotating unit carrying a plurality of columns of light sources arranged to sweep a common cylindrical surface, the light sources of each column being oriented parallel to each other at an angle to a radius from the axis of rotation through the column and the light sources of at least two of the columns being oriented at respective different angles.

In general, light sources such as light emitting diodes emit most of their light forwards along their optical axis, with the light intensity falling with increasing angle from the axis By varying the orientations of the columns, it is possible to provide a cylindrical image which remains visible close to the extremes of the cylindrical surface which are visible from any one point.

At least two of the columns may be offset relative to each other parallel to the rotational axis so as to provide interlacing.

According to a third aspect of the invention, there is provided a display, comprising a static unit, a rotating unit carrying a plurality of light sources, a motor for driving the rotating unit, and a control circuit for controlling the speed of the motor, the control circuit comprising means for repeatedly presetting a counter to a preset value, means for stepping the counter towards a predetermined value at a predetermined rate for a period related to the period of rotation of the motor, and means for supplying increased power to the motor when the counter reaches the predetermined value.

Such a system provides highly accurate motor speed control and, by using stable or similar clocks to control the light sources and the predetermined rate, dispenses with the need for any kind of synchronisation between the static and rotating units.

According to a further aspect of the invention, there is provided a display according to any combination of the first to third aspects of the invention.

According to a fifth aspect of the invention, there is provided a motor speed controller comprising means for repeatedly presetting a counter to a preset value, means for stepping the counter towards a predetermined value at a predetermined rate for a period related to the motor rotation period, and means for supplying increased motor power when the counter reaches the predetermined value.

BRIEF DESCRIPTION OF THE DRAWINGS

The invention will be further described, by way of example, with reference to the accompanying drawings, in which.

DETAILED DESCRIPTION OF THE PREFERRED EMBODIMENTS

Figure 1:
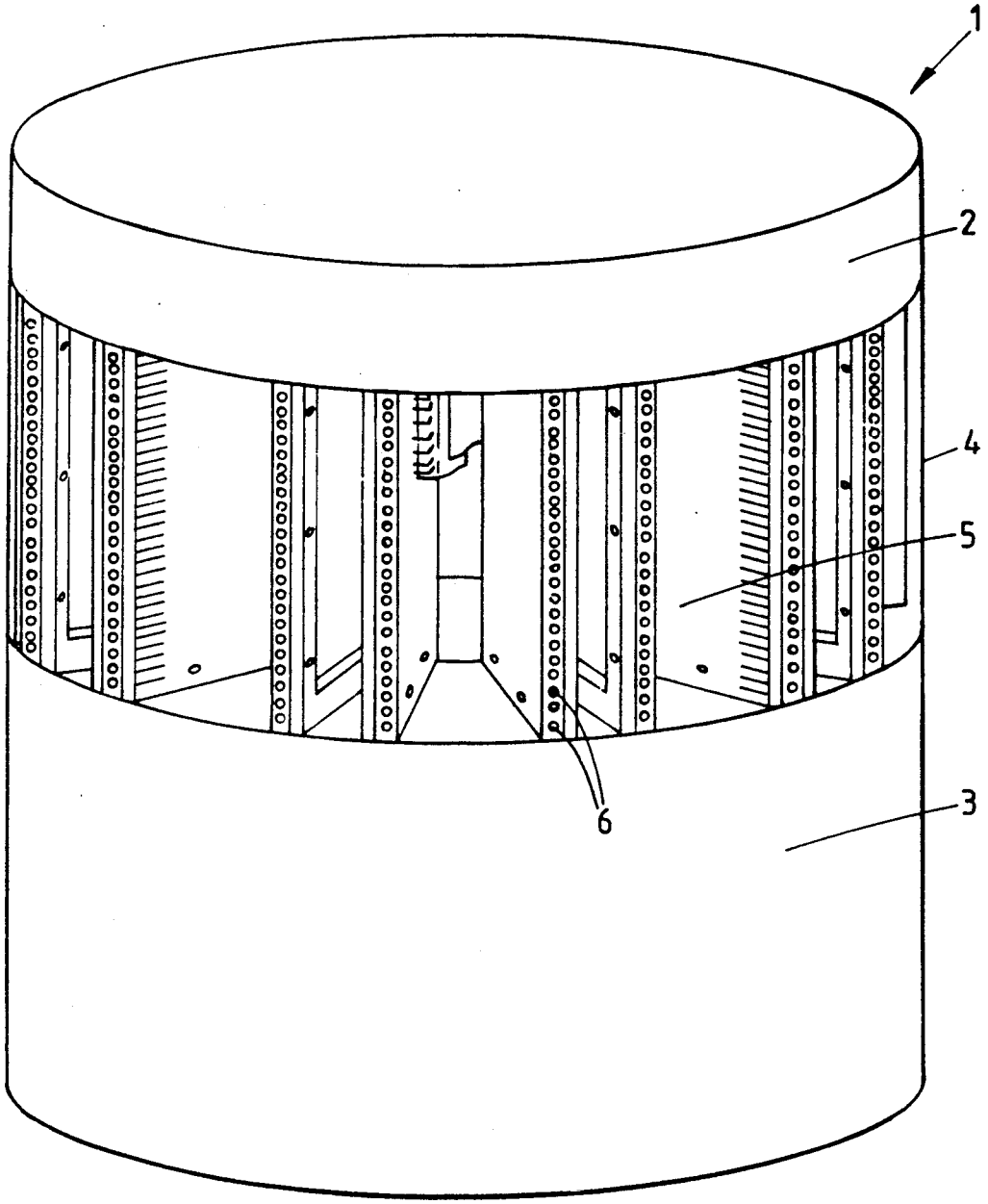
FIG. 1 is an external view of a display constituting a preferred embodiment of the invention.

The display 1 shown in FIG. 1 comprises a cylindrical case having opaque upper and lower parts 2 and 3 separated by a transparent middle part 4. A plurality of display cards 5 is visible through the transparent part 4, with each display card having at its radially outer edge a vertical column of thirty two light emitting diodes 6.

Figure 2:
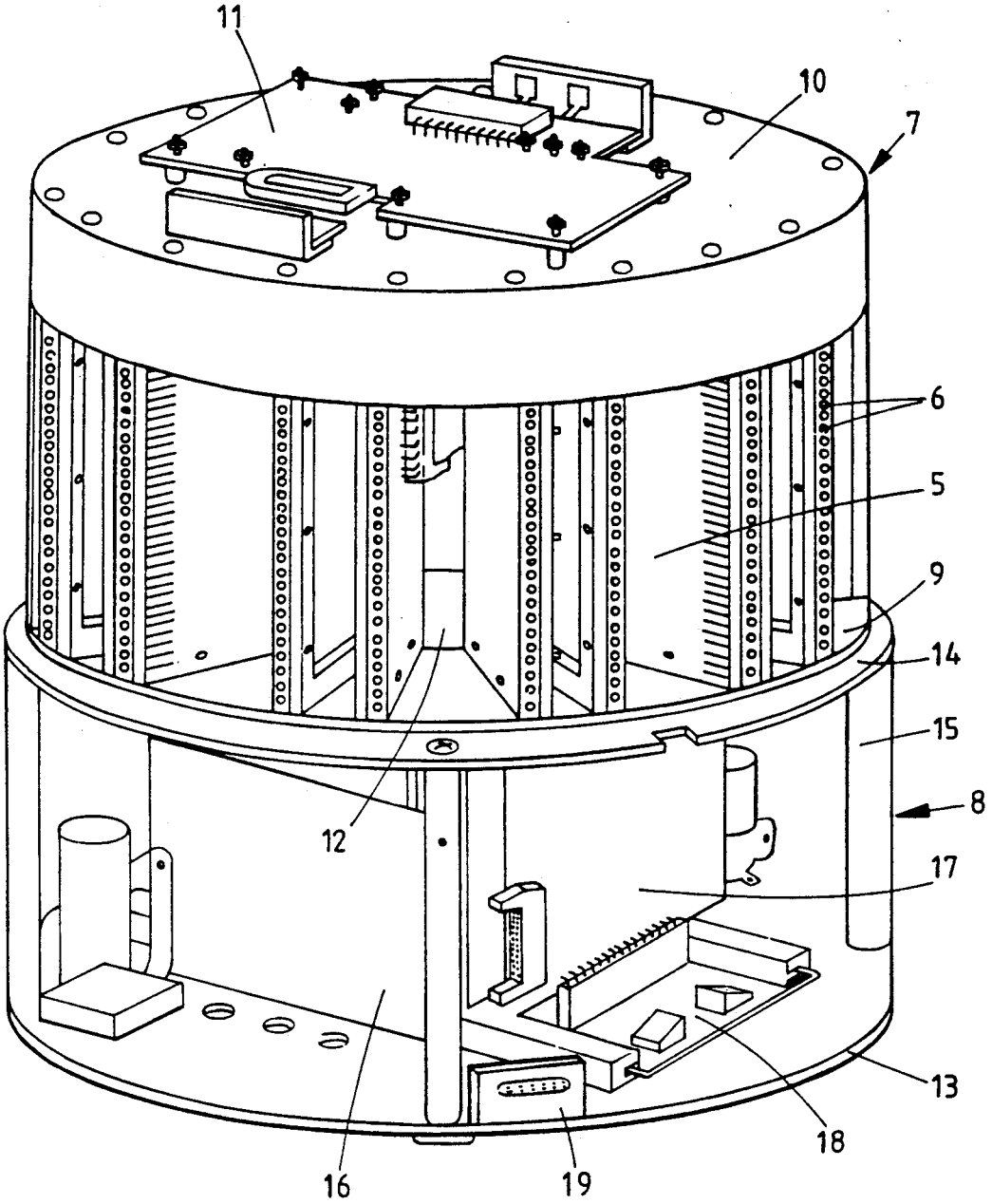
FIG. 2 shows the display of FIG. 1 with the case removed.

As shown in FIG. 2, the display cards 5 are mounted on an upper unit or carousel 7 which is rotatably mounted on a lower base unit 8. The cards 5 are supported between a lower carousel plate 9 and an upper carousel plate 10, which carries display control electronics on a control card 11. The carousel 7 is mounted on the shaft of a drive motor 12 which is fixed to the base unit 8. The base unit 8 has a base plate 13 rigidly connected to an upper plate 14 by spacers 15. The plate 13 also carries various circuit boards, such as 16, 17, and 18, and a serial port input connector 19.

Figure 3:
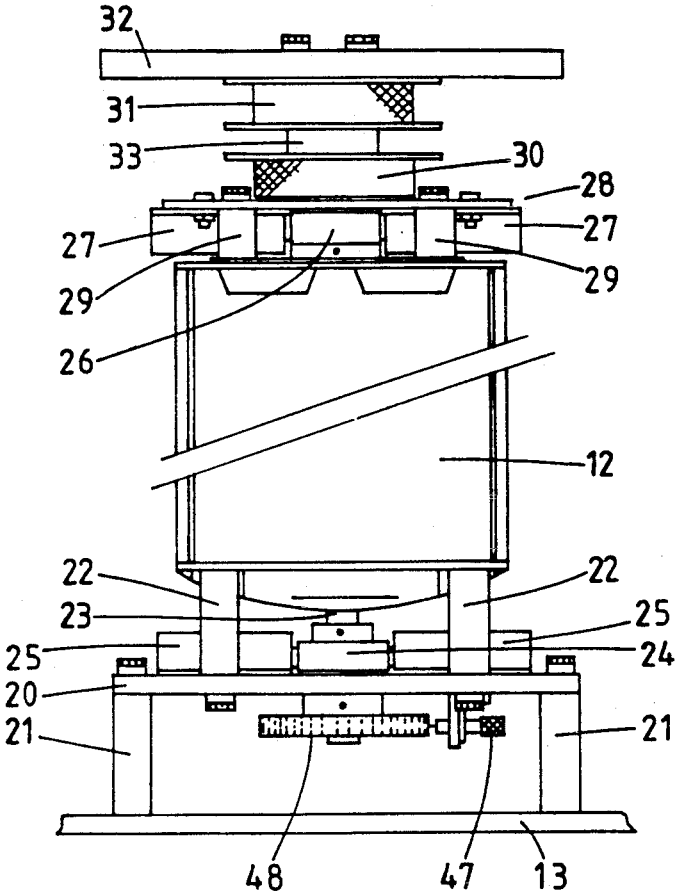
FIG. 3 is a side view of part of the display of FIG. 1.

As shown in FIG. 3, the base plate 13 provides a mounting for a support plate 20 which is mounted by means of pillars 21. The motor 12 is mounted to the support plate 20 by means of pillars 22.

The motor 12 has an output shaft 23 which extends above and below the motor. The shaft 23 is made of metal or other electrically conductive material and is provided with a slip ring 24 which co-operates with a pair of brushes mounted in brush holders 25. The brushes are connected to the common or earth line of a power supply mounted in the base unit 8.

The upper part of the motor shaft 23 is provided with another slip ring 26 which is electrically insulated from the shaft. The slip ring 26 co-operates with a pair of brushes mounted in brush holders 27. The brush holders 27 are fixed to a support plate 28 which is fixed by pillars 29 to the top of the motor 12. The brushes co-operating with the slip ring 26 are connected to a positive voltage output of the power supply in the base unit. The motor shaft and the slip ring 26 are connected to a power supply unit of the carousel 7 as will be described hereinafter.

A rotary transformer is provided for transmitting data from the base unit 8 to the carousel 7. The rotary transformer comprises a fixed assembly 30 mounted on the support plate 28 and a rotating assembly 31 mounted on a carousel support hub 32 provided with a boss 33 and fixed to the motor shaft 23. Each of the parts 31 and 32 of the rotary transformer comprises a ferrite ring supporting a coil or winding.

Figure 4:
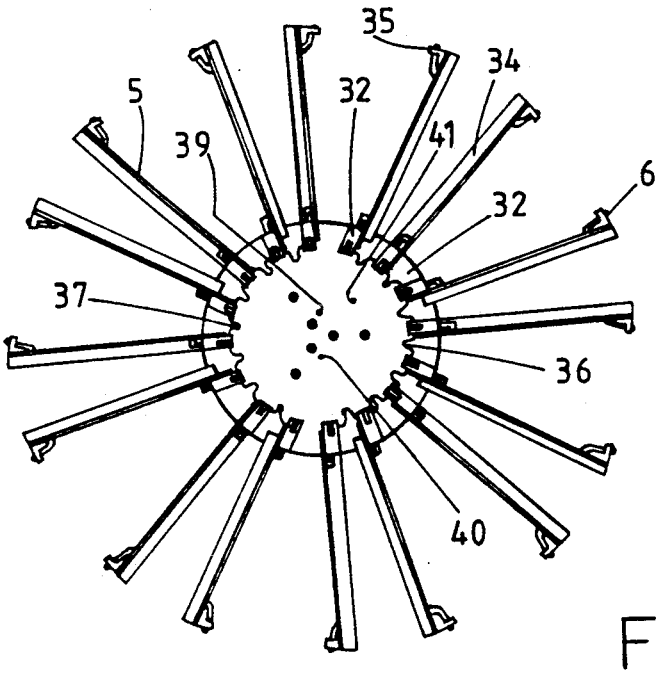
FIG. 4 is a plan view of another part of the display of FIG. 1.

FIG. 4 shows the arrangement of display cards or circuit boards 5 mounted on the carousel support hub 32. Each circuit board 5 is provided with a support frame 34 for support and for connection to the hub 32. The columns of light emitting diodes 6 are mounted on LED brackets 35. Sixteen display boards 5 are provided and are arranged as two groups of eight boards with the first set being connected to a ribbon cable bus 36 and the second set being connected to a ribbon cable bus 37. Display board connectors are shown at 38 and power supply and data connections from the slip rings 24 and 26 and from the rotary transformer secondary winding or part 31 are indicated at 39, 40, and 41.

Figure 5:
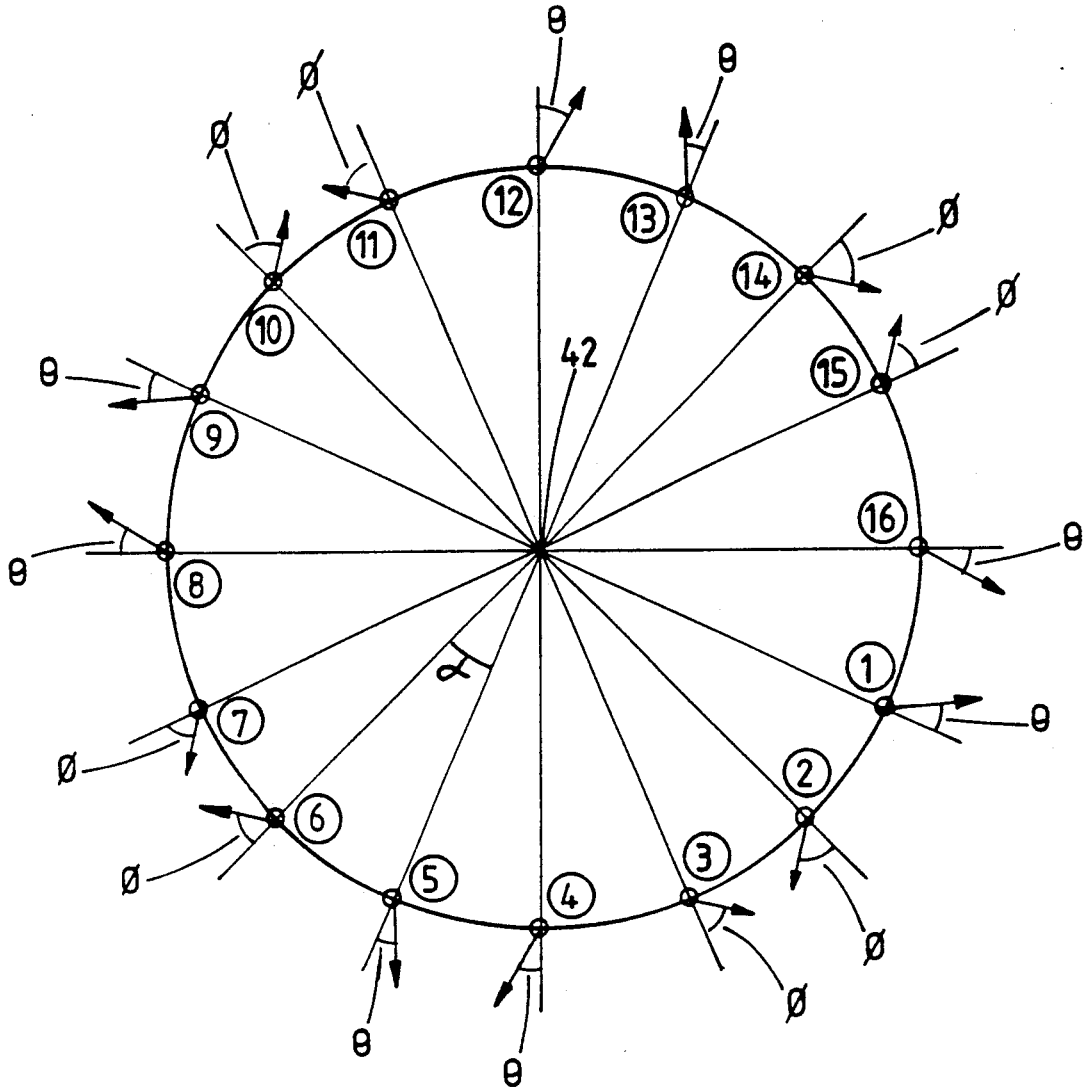
FIG. 5 is a diagrammatic plan view of the part of the display shown in FIG. 4.

FIG. 5 illustrates diagrammatically the positions and orientations of the columns of light emitting diodes with respect to the axis 42 of rotation of the carousel. The columns of light emitting diodes are labelled by numbers from 1 to 16 inside circles. The columns are equiangularly spaced about the circumference of the carousel such that the angle $\alpha$ between each adjacent pair of columns is equal to $22\frac{1}{2}°$. The arrows in FIG. 5 indicate the optical axis of each light emitting diode in the columns, with the axes of the light emitting diodes in each column being parallel. Thus, the light emitting diodes in the column labelled "1" are oriented at an angle of $\theta$ anti-clockwise with respect to a radius passing through the column, whereas the axis of the column "2" is displaced by an angle $\Phi$ clockwise with respect to the radius through the column. The orientations of the axes of the other columns are as shown in FIG. 5 and, in a preferred embodiment, the angle $\theta$ is 12° and the angle $\Phi$ is 48°. Such an arrangement compensates for the limited angular , dispersion of light from the light emitting diodes to either side of the optical axis, and permits light from the display to be received by a viewer for substantially the whole of the part of the cylindrical surface described by the columns of light emitting diodes facing the viewer In practice, the portion of the cylindrical surface which is visible and from which light can be seen is less than but close to 180°, for instance about 160°.

In order to provide a multi-colour image, columns of red light emitting diodes and columns of green light emitting diodes are provided. Thus, the columns "1", "4", "6", "7", "9", "12", "14", and "15" consist entirely of red light emitting diodes, whereas the other columns consist entirely of green light emitting diodes.

Further, the light emitting diodes in all of the columns are arranged to have a common pitch and the columns "1", "2", "3", "6", "7", "8", "12", and "13" are arranged at the same height so that the n-th light emitting diode in each of these columns follows exactly the same circular path The remaining columns are also at the same height as each other but are displaced upwardly with respect to the above mentioned columns by half the pitch of the light emitting diodes. Thus, the sixteen columns provide an interlaced display to improve the vertical resolution of the display.

Each of the columns "1" to "16" can thus be displaced from the local radius by one of two angles and in one of two directions, can be one of two colours, and can be in one of two interlaced groups. This gives sixteen possible combinations of parameters and all sixteen combinations are present in the sixteen columns of light emitting diodes.

As will be described hereinafter, the display is arranged to provide 512 discrete circumferential picture elements (pixels). In order for the circumferential display definition to be the same as the vertical definition, the pitch of the light emitting diodes in the columns is made equal to the circumference divided by 256 (the interlacing of the display giving the same vertical resolution as circumferential resolution).

Figure 6:
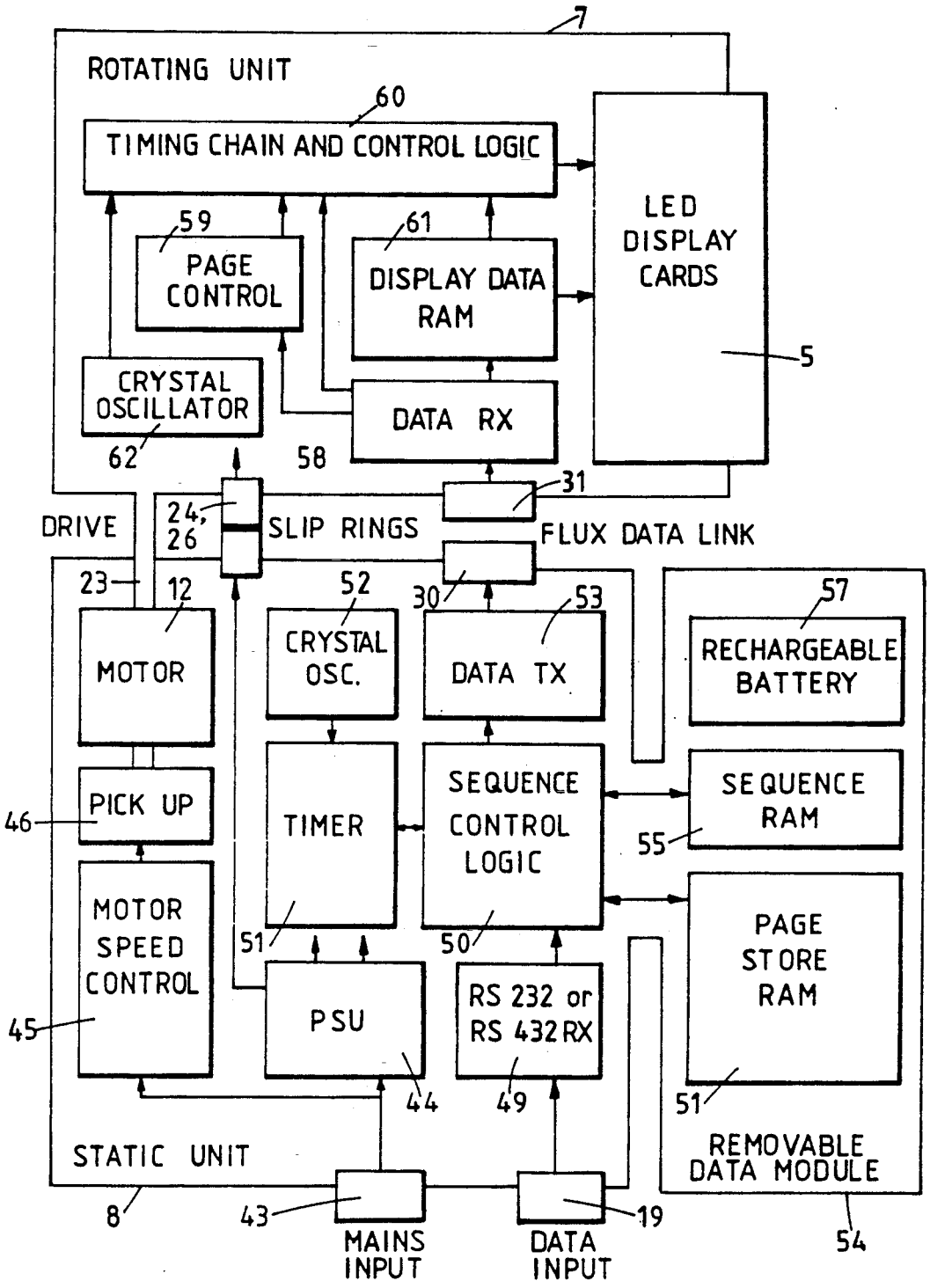
FIG. 6 is a block schematic diagram of the display of FIG. 1.

FIG. 6 is a block schematic diagram of the electronics in the static or base unit 8 and the rotating unit or carousel 7. A single block 5 represents the sixteen display cards.

A mains input connector 43 is connected to a power supply unit 44 which supplies power to the electronics in the base unit 8 and, via the slip rings 24 and 26, in the carousel 7. In addition, the mains input connector 43 is connected to a motor speed control circuit 45 which controls the supply of power to the motor 12 and controls motor speed by means of a servo loop which receives motor speed feedback signals from a variable reluctance pick-up 46 which, as shown in FIG. 3, comprises a fixed sensor 47 and a toothed wheel 48 mounted at the bottom of the motor shaft 23.

The data input connector 19 is connected to a receiver/decoder, for instance complying with the RS232 or RS432 standard. The output of the receiver 49 is connected to a sequence control logic circuit 50 which receives timing signals from a timer 51 controlled by a crystal oscillator 52. The sequence control logic circuit 50 has an output connected to a data transmitter 53 which sends data via the rotary transformer 30, 31 to the carousel 7. The sequence control logic circuit 50 is also connected to a removable data module 54 which comprises a sequence random access memory 55, a page store random access memory 56, and a rechargeable battery 57 for maintaining the contents of the memories 55 and 56 when the display is disconnected from the mains.

The carousel 7 comprises a data receiver 58 which receives data from the rotary transformer 30, 31 and which has outputs connected to a page control circuit 59, a timing train and control logic circuit 60, and display data random access memory 61. The logic circuit 60 is connected to outputs of the page control circuit 59 and the memory 61, and receives clock pulses from a crystal oscillator 62. The logic circuit 60 and the memory 61 are connected to the display cards 5 by the buses 36 and 37 shown in FIG. 4.

The display operates as follows. When the display is first actuated by supplying mains power to the input connector 43, the motor 12 rotates the carousel 7 and accelerates until a preselected speed of rotation is reached. The motor speed control circuit 45 then stabilises the rotary speed of the carousel at the preselected value. The speed is not actively synchronised in any way with the display electronics in the carousel 7, but speed stability is based on the stability of a crystal oscillator which is substantially identical to the crystal oscillator 62 which controls display timing. The crystal oscillator for the motor speed control circuit 45 may be provided by the crystal oscillator 42 or may be provided independently.

Meanwhile, display data are sent from the data module 54 by the sequence control logic circuit 50 via the data transmitter 53 and the rotary transformer 30, 31 to the carousel 7, whose electronics receive power via the slip rings 24, 26 from the power supply unit 44. Display and control data are received by the data receiver 58 and are stored in the display data memory 61. The timing chain and control logic 60 then cause data to be supplied from the memory 61 to the display cards 5 with appropriate timings to provide the desired displayed image.

The cylindrical display surface swept by the columns of light emitting diodes 6 is divided into 512 circumferential by 64 vertical pixels and the memory 61 contains data for providing four complete displays, each using all of the pixels and referred to hereinafter as a "page". At any one time, one of the pages is hidden or blanked and does not affect the display but instead is available to receive fresh display data from the base unit 8. The other three pages provide three display images which are superimposed so as to provide a complete image or "band".

The data for each pixel may control it such that it is off, green, red, or yellow (green and red). Data held in the page control circuit 59 allows each of the pages to commence at a selectable circumferential position.

The display timing is determined by the crystal oscillator 62 and a static image relies on substantially identical timing control within the motor speed control circuit 45. However, a rotating image may be obtained by selecting a variation in speed by means of the motor speed control circuit 45 or by periodically altering the circumferential starting position of one or more of the displayed pages. A degree of animation may also be achieved by loading fresh pages from the data module 54 into the display data memory 61 at a speed sufficient to provide an apparently changing image, or by displaying only one of the four pages stored in the memory 61 at a time and in sequence.

In a preferred embodiment, the circumferential starting position for each page can be selected as any one of 256 circumferential columns of pixels. The starting point thus has half the circumferential resolution of the display, but this has been found adequate in practice while relieving design and technical requirements on the electronics of the display.

Figure 7:
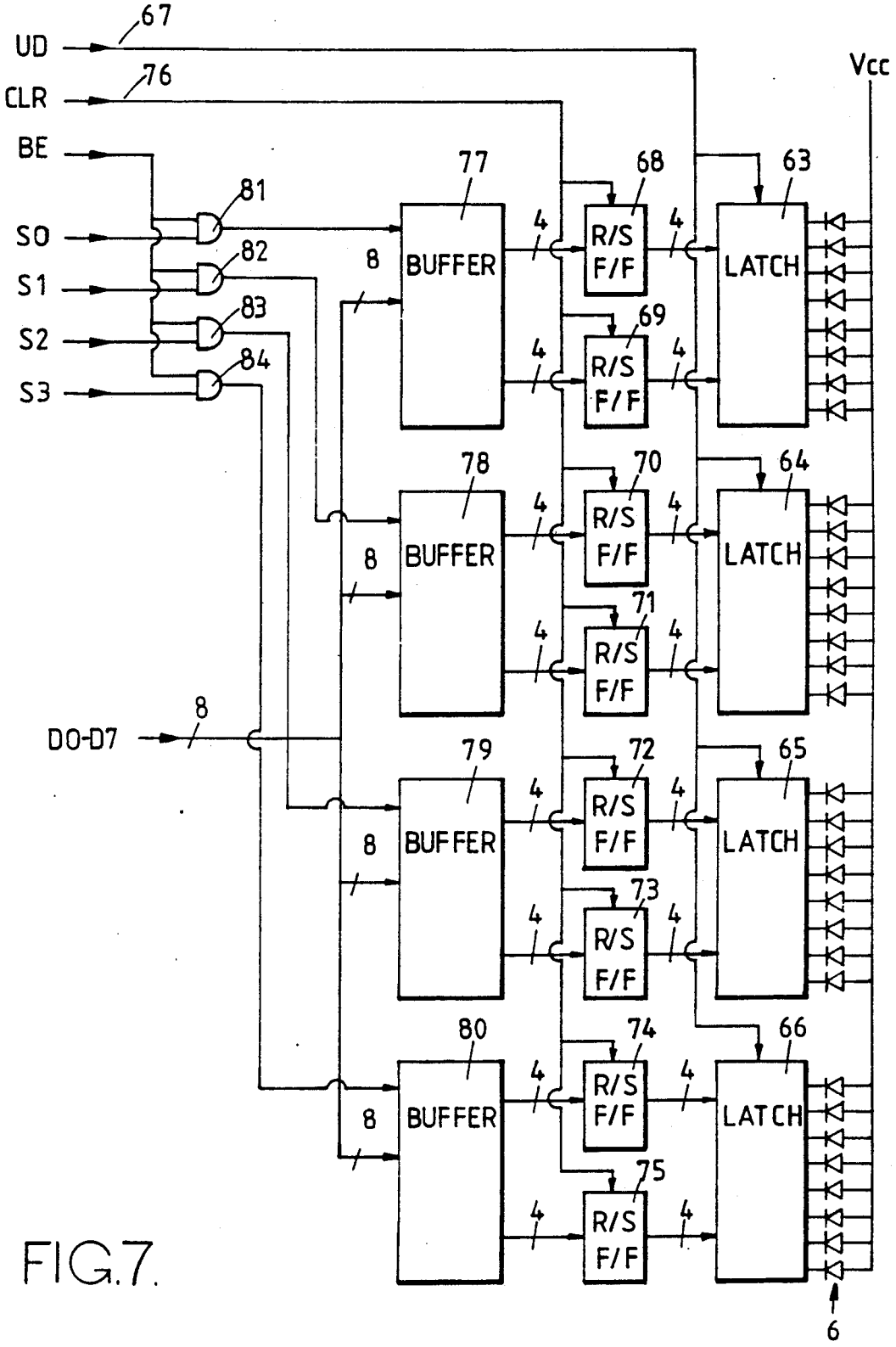
FIG. 7 is a circuit diagram of a display card of the display of FIG. 1.

FIG. 7 is a circuit diagram of one of the display cards 5. The card is implemented with high-speed TTL and CMOS integrated circuits of the 7400 series, available from various manufacturers, and the type numbers for the individual integrated circuits will be given hereinafter. For the sake of clarity, multi-line connections or buses are shown in the circuit diagrams as a single line with a short crossing line and associated number indicating the number of lines or channels making up the connection.

The thirty two light emitting diodes 6 are arranged as four groups of eight, with each group being controlled by a respective octal latch/driver 63 to 66 of the type 74LS374. The latch/drivers have latch enable inputs which are connected together and to a display card input 67 for receiving an update control signal UD. Each octal latch/driver comprises eight identical latches, each of which is controlled by the enable input and is capable of supplying sufficient current to drive the corresponding light emitting diode 6.

The data inputs to each latch/driver 63 to 66 are connected to the outputs of set/reset flip/flops 68 to 75, each of which comprises a quad set/reset flip/flop of type 74LS279. The flip/flops 68 to 75 have clear inputs which are connected to a display board input 76 for receiving a clear signal CLR.

The set inputs of the flip/flops 68 to 75 are connected to the outputs of four octal buffer tri-state line drivers 77 to 80 of type No.74HC244, whose data inputs are connected in parallel to a common 8-line bus for receiving display data signals D0 to D7. The octal buffers 77 to 80 have enable inputs connected to the outputs of AND gates 81 to 84, respectively. The AND gates 81 to 84 have first inputs connected to receive strobe signals SO to S3, respectively, and second inputs connected together to receive a board enable signal BE.

The input signals UD, CLR, BE, S0 to S3, and D0 to D7 are received from the bus 36 or 37, depending on whether the particular card 5 is a member of the group "1", to "8 " or "9" to "16". In addition, a supply line $V_{cc}$ and a common line (not shown) are connected to the respective bus, which provides power to the display card 5.

In order to write new data for controlling the light emitting diodes 6 to each display card 5, a board enable signal BE is supplied to the selected card. The gates 81 to 84 are therefore opened and the board is ready to receive the strobe signals S0 to S3. Data D0 to D7 are supplied to the octal buffers 77 to 80 for controlling the light emitting diodes connected to the octal latch 63. The strobe signal S0 is supplied so as to enter the data in the octal buffer 77, and hence into the flip/flops 68 and 69.

Data for the next group of eight light emitting diodes is then supplied on the bus as bits D0 to D7 and the strobe signal S1 is supplied so as to enable the octal buffer 78 and enter the data in the flip flops 70 and 71. This process is repeated until the data for one column of pixels for one of the three pages to be displayed has been entered in the flip/flops 68 to 75. The whole process is then repeated for the same column of pixels for the second page to be displayed, without clearing the flip flops 68 to 75. The new data is therefore effectively superimposed on the data for the previous page. The process is then repeated again for the third page, after which the board enable signal BE is removed This process is repeated for each of boards "1" to "8" and simultaneously for boards "9" to "16" via the two data buses 36 and 37 so that the data for displaying the next sixteen columns of pixels are entered in the flip/-flops of all sixteen display boards. At the end of this cycle, the update signal UD is supplied to all sixteen boards so that the new data are written into the latches 63 to 66 simultaneously on all boards and the sixteen next circumferential columns of pixels are displayed in place of the previous ones. A clear signal CLR is then supplied to all sixteen boards so as to reset all of the flip/flops 68 to 75 in readiness for receipt of the data for the next columns of pixels.

Figure 8:
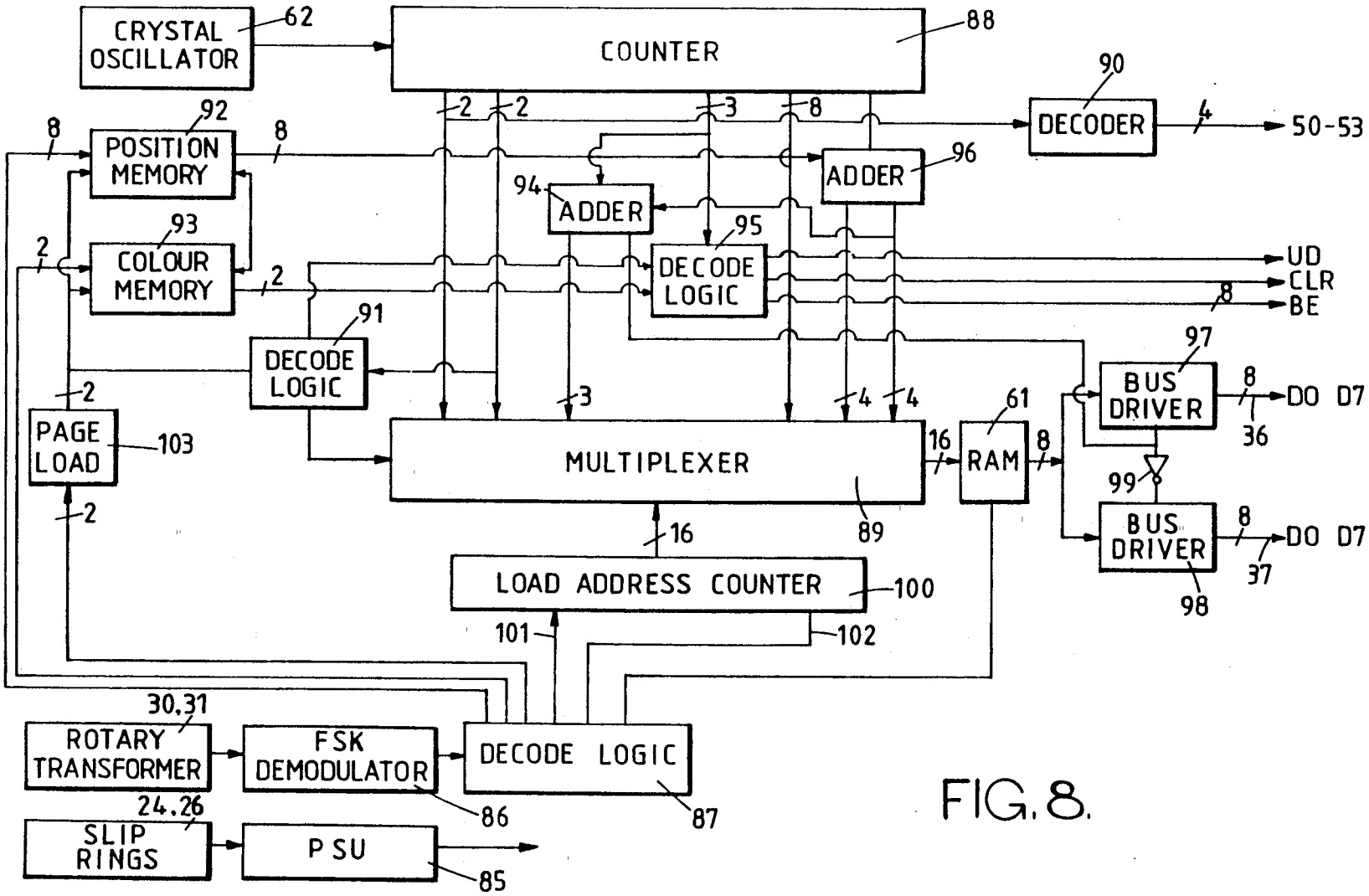
FIG. 8 is a block circuit diagram of a rotating control circuit of the display of FIG. 1.

The data receiver 58, the page control circuit 59, the timing chain and control logic circuit 60, the display data random access memory 61, and the crystal oscillator 62 are shown in more detail in FIG. 8.

The carousel 7 has a local power supply unit 85 which receives power from the slip rings 24, 26 and supplies power to the electronics shown in FIG. 8 and to all of the display boards 5.

The rotary transformer 30, 31 is connected to a frequency shift keying (FSK) demodulator 86 whose output is connected to a decode logic circuit 87. The logic circuit 87 has an output connected to a data input of the memory 61, and further outputs whose connections will be described hereinafter.

The crystal oscillator 62 supplies clock pulses to a 16 bit binary counter 88 whose least significant bit outputs are shown at the left with the significance of the bit outputs increasing progressively to the right. Thus, the two least significant bit outputs are connected to inputs of a 16 bit 2-to-1 multiplexer 89 and to the inputs of a decoder 90 which decodes the two bits to 1-of-4-outputs which provide the strobe signals SO to S3 for the display boards. The next two counter outputs provide a two bit code to the multiplexer 89 and indicate which of the four pages making up a band is currently being addressed. These outputs are also connected to a decode logic circuit 91 and to a 4 by 8 bit position random access memory 92 and a 4 by 2 bit colour random access memory 93. The next three outputs of the counter 88 are supplied to a four bit adder 94 and to a decode logic circuit 95. The three bits at these outputs indicate the display boards of the first and second groups which are currently being addressed, and the decode logic circuit 95 decodes these bits and signals from the decode logic circuit 91 so as to provide 1-of-8 outputs constituting eight board enable signals BE together with the clear signal CLR and the update signal UD. The decode logic circuit 91 supplies a signal to the decode logic circuit 95 indicating the currently selected blank page so as to prevent data from being written to the display boards.

The most significant nine outputs of the counter 88 are used to select the sixteen columns of pixels to be written to the sixteen display cards. The least significant of these nine outputs is connected direct to the multiplexer 89 whereas the remaining eight outputs are connected to an 8 bit adder 96 which is also connected to the 8 bit output of the position memory 92. The position offset for the currently selected page is thus added to the eight most significant bits and the sum is supplied to the multiplexer 89. In order to synchronise the data correctly, the four most significant bits of the sum from the adder 86 are supplied to the adder 94, whose least significant three bit outputs are connected to the multiplexer 89 and whose most significant bit output controls a data bus driver 97 direct and a data bus driver 98 via an inverter 99. The outputs of the drivers 97 and 98 are connected to the buses 36 and 37, respectively, whereas the inputs of the drivers 97 and 98 are connected in parallel to the data outputs of the page data memory 61, which is a 16k by 8 bit memory.

The decoder logic circuit 91 has an output signal connected to the control input of the multiplexer 89, whose outputs are connected to the address inputs of the memory 61. A 16 bit load address counter 100 has its outputs connected to the other inputs of the multiplexer 89 and has an increment input 101 and a reset input 102 connected to the decode logic circuit 87. The memories 92 and 93 have data inputs connected to outputs of the decode logic circuit 87. A page load circuit 103 has a two bit output connected to the memories 92 and 93 and has a two bit input connected to the decode logic circuit 87.

At any one time, one of the four pages whose display data are held in the memory 61 is designated by the base unit as a blank page which is not to be displayed so that data for this page may be written to the memory 61. Whenever the third and fourth outputs of the counter 88 select this page, which may be changed as desired in the base unit, the page load circuit 103 makes the memories 92 and 93 ready to receive new page position and colour data whereas the decode logic 91 blanks the display and switches the multiplexer so as to receive an address from the load address counter 100. The data supplied in FSK form via the rotary transformer 30, 31 has a relatively slow bit rate which is much slower than the rate at which data are transferred from the memory 61 to the display boards 5. However, this does not matter as it is not required to update the memory 61 at such a fast rate. Increment and reset control signals to the load address counter 100 allow data supplied to the data input of the memory 61 to be written to the correct location irrespective of the state of the outputs of the counter 88.

When the two bit page output of the counter selects the next page, the decode logic circuit 91 switches the multiplexer 89 so that the counter 100 is disconnected from the address inputs of the memory 61 and the other multiplexer inputs address the memory. Further, the memories 92 and 93 are returned to the read mode, the data input to the memory 61 is disabled, and the decode logic circuit 95 begins supplying board enable signals BE for writing to the display boards.

The colour memory 93 contains a two bit code defining the colour for each of the four pages for which display data are currently stored in the memory 61. The four states of these two bits represent black, red, green and yellow (red and green). These data are decoded in the decode logic circuit 95, together with the currently selected display board, to ensure that the appropriate data are written to board, which contains only red or only green light emitting diodes. The control circuit shown in FIG. 8 thus applies, for each of the three pages which are currently to be displayed, the display data for controlling each of the four groups of light emitting diodes in turn for each of the three pages in turn for each of the two display boards connected to the buses 36 and 37 in turn for each set of sixteen columns of picture elements in turn which are to be displayed next by the display boards, cycling through the complete set of circumferential columns in sixteen such cycles.

The removable data module 55 contains data relating to many pages and bands to be displayed and the sequence memory 55 defines the sequence in which page data from the memory 56 are selected by the sequence control logic circuit 50 for transmission to the carousel. The timing of transmission of new page data to the carousel is controlled by the timer 51. The module 54 may be replaced by other modules defining different display sequences in order to adapt the display for a desired application. New data may also be supplied via the input port 19 "on line" from, for instance, a modem connected to a remote computer or a portable computer connected to the input port 19.

Display data supplied from any suitable source to the input port 19 may be used to reprogrammed the memories 55 and 56 with the new data, and may even be used to write new data directly to the memory 61. These functions are controlled by the sequence control logic circuit 50. Thus, it is possible to enter new data without changing the removable data module 55. If desirable, the input port 19 could be permanently connected to a source of display data, thus permanently augmenting or replacing the function of the module 54.

Figure 9:
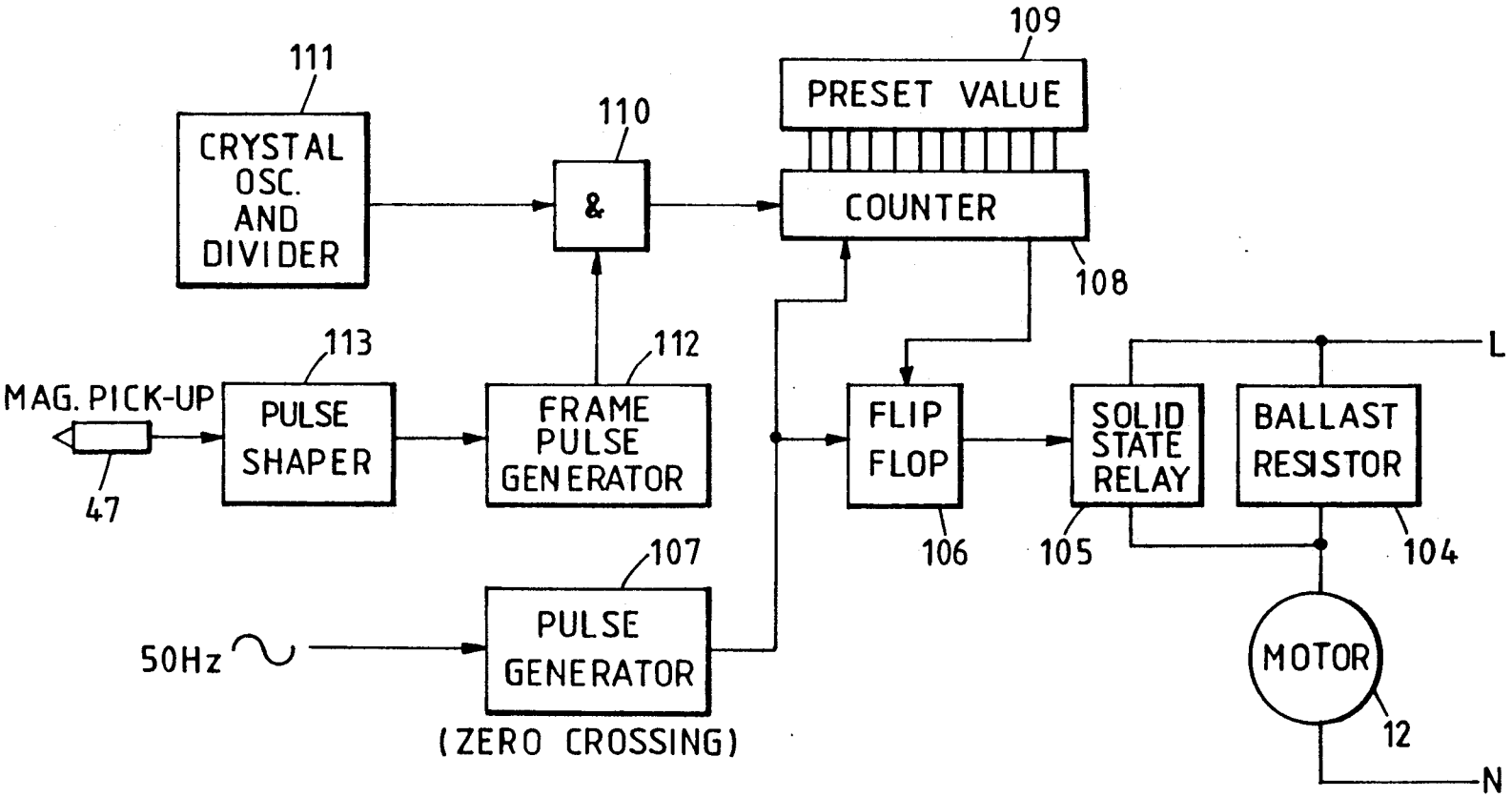
FIG. 9 is a block circuit diagram of a motor control arrangement of the display of FIG. 1.

The motor speed control circuit 45 is shown in more detail in FIG. 9. The motor 12, which is an AC induction motor, is connected in series with a ballast resistor 104 between Live and Neutral lines connected to the mains input connector 43. A solid state relay 105 based on a triac is connected in parallel with the ballast resistor 104 and has a control input connected to the output of a flip/flop 106.

The flip/flop has a reset input connected to the output of a pulse generator 107 which has an input connected to receive the 50 or 60 Hz AC mains input and which is arranged to produce an output pulse at a predetermined time delay after each zero crossing of the mains supply. The output of the pulse generator 107 is connected to a load input of a counter 108 so as to preset the counter to a preset value selectably determined by a plurality of switches 109 connected to counter preset inputs for selecting the desired speed of rotation of the motor 12. The counter 108 has an output which is activated when the counter reaches the zero state, this output being connected to a set input of the flip/flop 106.

The counter 108 has a count-down clock input connected to the output of an AND gate 110 having a first input which receives clock pulses from a crystal oscillator and frequency divider 111 and a second input connected to the output of a frame pulse generator 112. The input of the generator 112 is connected to the output of a pulse shaper circuit 113 whose input is connected to the sensor 47 which, together with the toothed disc 48, forms the motor speed pick-up transducer 46. The pulse shaper 113 shapes the output signal of the transducer and the frame pulse generator 112 converts this into a frame pulse whose duration is inversely proportional to the rotary speed of the motor shaft 23.

During each half cycle of the mains current, the pulse generator 107 resets the flip/flop 106 and presets the counter 108 to the preset value defined by the switches 109. The frame pulse generator 112 opens the gate 110 to pass the clock pulses from the crystal oscillator and divider 111 so as to decrement the counter 108 until the end of the frame pulse. If the speed of rotation of the motor is too slow, the frame pulse is long enough to allow the counter 108 to be decremented to zero so that the counter sets the flip/flop 106. The flip/flop 106 thus actuates the solid state relay 105 which in turn shorts out the ballast resistor 104. The motor power is therefore increased and the motor accelerates. The next pulse from the pulse generator 107 resets the flip/flop, thus deactivating the relay 105 so that the power to the motor 12 is reduced by the ballast resistor 104.

When the motor speed exceeds the preset value, the frame pulse generated by the generator 112 is too short to allow the counter 108 to be decremented to zero between consecutive pulses from the generator 107. The flip/flop is therefore not set and the solid state relay 105 remains off so that the ballast resistor 104 is not shorted. The reduced power to the motor 12 thus allows the motor to decelerate until the frame pulse is again long enough for the counter 108 to be decremented to zero.

This motor speed control circuit provides very fine control of speed and, by appropriate selection of parameters, such as the value of the ballast resistor 104, the size of the counter 108 and the output frequency of the oscillator and divider 111, the actual motor variation once the desired speed has been achieved is very small and imperceptible to a viewer of the display.

The display may be used in a variety of applications, such as displaying information or advertising material in shop windows The light output is sufficiently high for the display to be clearly visible in direct sunlight, and the display provides an attractive and eye-catching image. The images to be displayed can be changed in a preprogrammed sequence and new sets of images can easily be programmed into the display by changing the removable data module 54 or by supplying data through the input port 19 and thus not requiring any hardware changes. New data may be supplied by a portable computer temporarily connected to the input port 19. Alternatively, new data may be supplied to the input port 19 from a modem connected to a telephone line. The display can be made in a variety of sizes and may be permanently fixed at a site or may be sufficiently compact to be transportable. The images provided by the display may even be changed sufficiently quickly to provide a degree of image movement or animation. Images may be stationary on the cylindrical display area or may rotate, for instance by varying the motor speed under software control in addition to or in place of the speed selection switches 109 or by varying the page positions by periodically writing new positions to the memory 92 from the base unit.

Although the embodiment described uses 16 interlaced columns of light emitting diodes and is restricted to green and red light emitting diodes with a vertical resolution of 64 pixels and a circumferential resolution of 512 pixels with each pixel being capable of being displayed as black, red, green, or yellow, this is purely by way of example and any other suitable values for these display parameters could be chosen Thus, a different number of columns could be used, different vertical and circumferential resolutions could be provided, light emitting diodes or other light emitting devices of different and/or additional colours could be employed, and the intensity of each picture element colour could be controlled so as to have additional intermediate intensities between off and full-on.

We claim:

1. A display comprising a static unit and a moving unit, said moving unit carrying a plurality of light sources and being arranged to move relative to the static unit so that said light sources perform a repeated movement, said moving unit including a memory for storing data for providing a plurality of displayed images and control means for controlling said light sources so as to display at least one selected image at a time, said static unit containing a further memory for storing data for a plurality of further displayed images and transmission means for transmitting the data from said further memory to said memory and said control means of said moving unit via a communication link and wherein the moving unit is a rotating unit and the light sources are arranged as a plurality of columns parallel to the axis of rotation, with the light sources in each column lying in a common plane and the planes of at least two of said columns having their optical axes angularly offset relative to each other and disposed parallel to the rotational axis so that the image visible from any point covers an extended cylindrical surface.

2. A display as claimed in claim 1, in which the light sources are light emitting diodes.

3. A display as claimed in claim 1, in which the communication link is a rotary transformer.

4. A display comprising a static unit and a rotating unit, said rotating unit carrying a plurality of light emitting diodes arranged as a plurality of columns, said columns being parallel to the axis of rotation and said light emitting diodes of each individual column of said columns having optical axes orientated parallel to one another within said individual column and in a plane disposed at an angle to a radius from the axis of rotation through said individual column, said light emitting diodes of at least two of said columns having their optical axes orientated at respective different angles so that an image displayed by the rotating unit viewed from one point covers an extended cylindrical surface.

5. A display as claimed in claim 4, in which said rotating unit is arranged to move relative to the static unit so that said light emitting diodes perform a repeated movement, said rotating unit further comprising a memory for storing data for providing a plurality of displayed images and control means for controlling said light emitting diodes so as to display at least one selected image at a time.

6. A display as claimed in claim 4, in which said light emitting diodes of at least two of said columns are offset relative to each other in the direction parallel to the rotational axis so as to provide interlacing.

7. A display comprising a static unit and a rotating unit, said rotating unit carrying a plurality of light emitting diodes and being arranged to move relative to said statis unit so that said light emitting diodes perform a repeated movement, said light emitting diodes being arranged as a plurality of columns parallel to the axis of rotation of said rotating unit, said light emitting diodes of at least two of said plurality of columns having their optical axes angularly offset relative to each other so as to provide an extended cylindrical display, and said light emitting diodes of at least two of said plurality of columns being offset relative to each other in a direction parallel to the axis of rotation so as to provide interlacing, said rotating unit including a memory for storing data for providing a plurality of displayed image and control means for controlling said light emitting diodes so as to display at least one selected image at a time.

8. A display as claimed in claim 7, in which said static unit contains further memory for storing data for a plurality of further displayed images and transmission means for transmitting the data from said further memory to said memory and said control means of said rotating unit via a communication link.

* * * * *